US005094388A

United States Patent [19]

Chapman, Jr.

[11] Patent Number: 5,094,388

[45] Date of Patent: Mar. 10, 1992

[54] PORTABLE DRINKING FOUNTAIN FOR CHILDREN

[76] Inventor: Luther Chapman, Jr., Rte. 1, Box 72, Pomaria, S.C. 29126

[21] Appl. No.: 644,946

[22] Filed: Jan. 23, 1991

[51] Int. Cl.[5] ..... E03B 9/20

[52] U.S. Cl. ..... 239/29.3; 222/108; 222/131; 222/401

[58] Field of Search ..... 239/28-30, 239/120, 121; 222/108, 129, 130, 131, 175, 183, 401; 220/23.4, 23.83, 527, 528, 909

[56] References Cited

U.S. PATENT DOCUMENTS

| | | | |
|---|---|---|---|
| 1,038,021 | 9/1912 | Summers | 222/108 |
| 1,062,209 | 5/1913 | Williams, Jr. | 239/29.3 |
| 1,754,377 | 4/1930 | Tower | 239/28 |
| 1,979,604 | 11/1934 | Burdge | 222/108 |
| 2,080,923 | 5/1937 | Lassen | 222/108 |
| 2,238,093 | 4/1941 | Brandt | 239/24 |
| 2,575,936 | 11/1951 | Andrews | 239/29.3 |
| 2,621,073 | 12/1952 | Behrens | 239/24 |
| 2,899,137 | 8/1959 | Martin | 239/29.3 |
| 2,948,476 | 8/1960 | Don | 239/24 |
| 3,113,723 | 12/1963 | Arnt | 239/29.3 |
| 3,142,443 | 7/1964 | Morgan | 239/24 |
| 3,497,140 | 2/1970 | Puegner | 239/29.3 |

*Primary Examiner*—Andres Kashnikow
*Assistant Examiner*—Karen B. Merritt
*Attorney, Agent, or Firm*—Michael A. Mann

[57] ABSTRACT

A portable drinking fountain with a pressurized container for providing a liquid and a second container for receiving unconsumed liquid, both housed in a shell with a lid which carries a spout from the pressurized container and a drain leading to the second container. The shell is keyed for orienting the two containers within and allows easy portability of the fountain and its containers. The lid is removable for cleaning and filling of the containers with water or other drinkable beverage.

11 Claims, 1 Drawing Sheet

PORTABLE DRINKING FOUNTAIN FOR CHILDREN

BACKGROUND OF THE INVENTION

1. Field of the Invention

The present invention relates to drinking fountains, and more particularly to portable drinking fountains for children.

2. Discussion of Background

When children play outdoors, they become thirsty frequently and need to have a ready supply of liquid refreshment available. Open containers tend to spill or attract insects and closed containers tend to be too difficult for small children to operate. A variety of different techniques are available for supplying drinking water and the like from a portable fountain. Some techniques include pressurizing the liquid within a container connected to the fountain so that the liquid may be forced out of the spout of the fountain in an arc. Other techniques include spouts with bowls and drain pipes and rely on the pressure from a garden hose or outdoor faucet to create the arc from the spout. There is no means for catching the overflow from these various fountains. The overflow simply collects on the ground around the fountain, eventually making puddles which must be avoided when one desires to use the fountain. Children thoroughly enjoy using drinking fountains. Children are also attracted to puddles, much to the disgust of parents, therefore none of the techniques used in portable fountains has proven suitable for children. There is a need for a portable fountain which will not create puddles and will therefore be suitable for use by children.

SUMMARY OF THE INVENTION

The present invention addresses the problems of providing drinks to children while they play outdoors. In accordance with its major aspects, the portable drinking fountain for children provides a supply of liquid refreshment served under pressure through a drinking spout housed in an outer shell incorporating a drain system.

A feature of the present invention is the portability of the fountain. All the components are housed in the outer shell and easily transported. The outer shell may be made of plastic or other durable material and may be insulated so that the proper temperature of the liquid is retained.

In accordance with another aspect of the present invention, a hand pump incorporated in the container for the liquid allows pressure to be easily applied so that the liquid flows in an arc when a child depresses a button on the spout. This hand pump may be of the type used in pressurized spray containers or the like. While somewhat difficult for children to operate, this type pump is easily operated by an adult.

Another feature of the present invention is the drain system. The lid of the outer shell is sloped downward toward the center where a screen covers the drain connected to a hose or tubing. The connecting hose or tubing empties the liquid from the drain into a separate container slightly smaller than the pressurized container. One advantage of this drain system is no puddles form around the fountain. Another advantage of the drain system is the containment of the drain liquid until convenient disposal can be arranged. By containing the waste liquid, no insects are attracted as with open containers or spilled liquids.

In accordance with another aspect of the present invention, the two containers are shaped to nest snugly inside the shell. This configuration of containers maximizes the space within the shell, keeps the overall size compact, and discourages tipping of the fountain.

A related feature of the present invention is the tongue in the shell shaped to align with a groove in the side of the drain container. A similar tongue is shaped into the opposite side of the drain container to align with a groove in one side of the other container. This tongue-in-groove design allows only one orientation of the two containers within the shell, thereby simplifying the assembling of the fountain.

Yet another related feature of the present invention is the hose connections of the two containers. By designing each container to receive a unique hose or tube connection, the pressurized container will only be connectable to the spout and the waste container to the drain.

Another feature of the present invention is the removable lid of the shell. The lid makes up the entire top of the fountain and its removal gives free access to the two containers and hoses or tubing within the shell, simplifying filling and cleaning operations.

Other features and advantages of the present invention will be apparent to those skilled in the art of drinking fountains from a careful reading of the Detailed Description of a Preferred Embodiment accompanied by the following drawings.

DETAILED DESCRIPTION OF A PREFERRED EMBODIMENT

Figure 1:
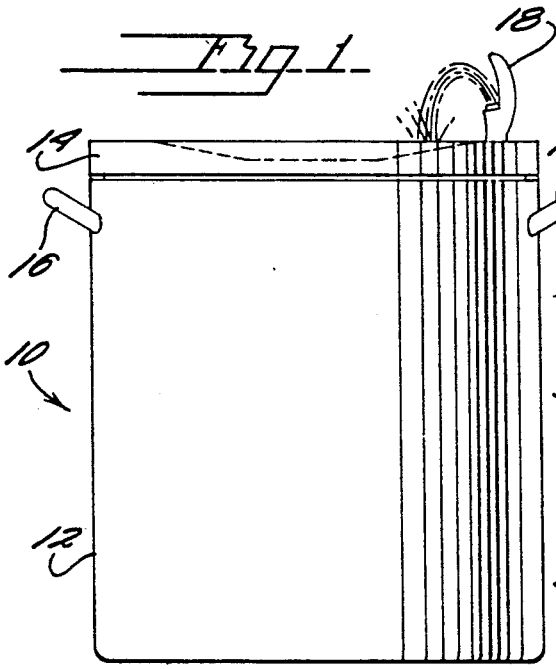
FIG. 1 is a side view of the preferred embodiment of the present invention.
Figure 2:
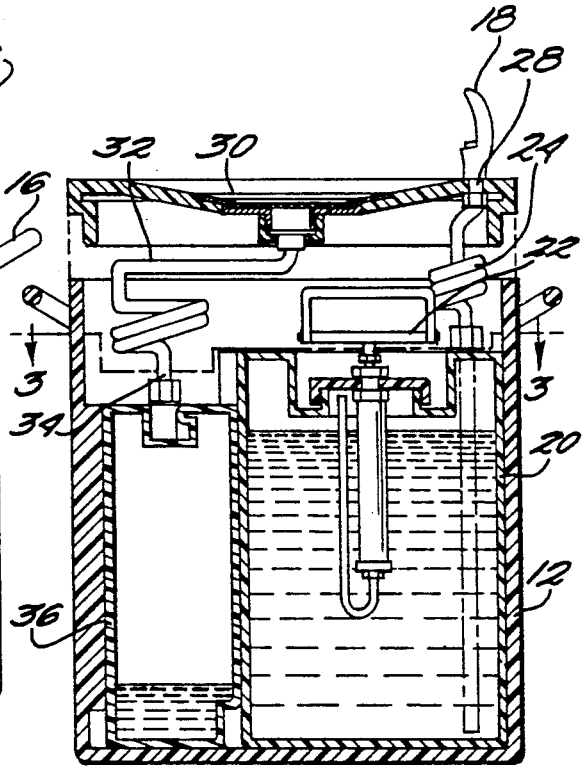
FIG. 2 is a partially expanded cross section of the present invention.

A presently preferred embodiment of the fountain is illustrated by reference numeral 10 in FIGS. 1 and 2. Fountain 10 is comprised of a shell 12 and a lid 14. Shell 12 has convenient handles 16 for carrying fountain 10. Lid 14 contains a drinking spout 18 through which the liquid is presented in an arc to the drinker. Liquid is stored in a first container 20 located within shell 12. The liquid is presented or made to flow in an arc from spout 18 by one or more of several methods. For example, if fountain 10 is positioned appropriately, gravity acting on the liquid causes it to flow in an arc when released from container 20. In the embodiment illustrated, first container 20 has a hand pump 22 which may be used to apply pressure to the liquid within first container 20. When spout 18 is activated, the pressure in container 20 is partially released causing the liquid to flow from first container 20 through spout 18 under pressure, presenting an arc from which one may drink. Hand pump 22 also acts as the lid of first container 20 as well as the carrying handle for transporting first container 20. Hand pump 22 may be of the usual variety used in portable spray cannisters. By repeatedly pumping the handle, air pressure is increased on the liquids within first container 20. Hand pump 22 acts as a lid locking in the pressurized liquid. A flexible tubing or hose 24 connects first container 20 with spout 18. Spout 18 has an activating button 26 (seen in FIG. 4) which relieves the pressure, forcing liquid up through hose 24 and spout 18. The base 28 of spout 18 is anchored in lid 14. Liquids not consumed are caught in lid 14 and collected at the drain 30 of lid 14. Drain 30 is connected to another hose 32 which is attached at its distal end 34 to a second container 36. By collecting the waste liquid in this manner, no puddles form around fountain 10 from overflow.

Figure 3:
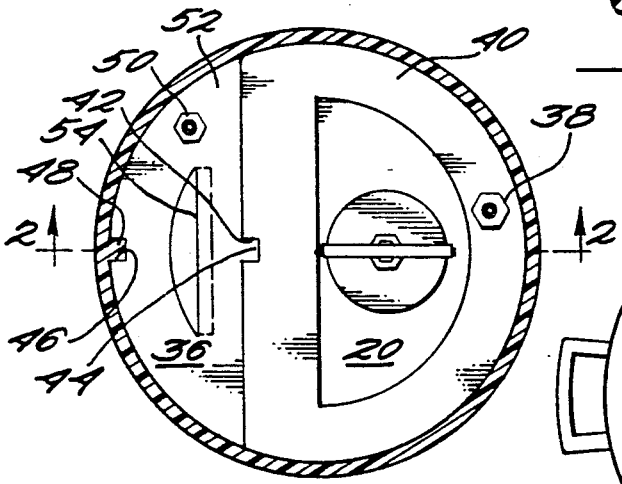
FIG. 3 is a cross section of the present invention along the line 3—3 of FIG. 2.

Details of the nesting configuration of the two containers are illustrated in FIG. 3. First container 20 is larger than second container 36. First container 20 has hose attachment 38 located at the outer ridge 40 in order to be located proximate to spout 18 of lid 14. First container 20 has a groove 42 formed in one side to receive the tongue 44 of second container 36. Second container 36 has a groove 46 located in the side opposite tongue 44. Groove 46 receives tongue 48 of shell 12. This tongue-in-groove configuration makes only one configuration of containers possible, adjacent, side-by-side alignment as shown thereby simplifying the assembling of fountain 10 after cleaning or repair. The two containers are shaped to nest against each other allowing maximum liquid volume in the space available within shell 12. The containers and shell may be made of any suitable heavy plastic or metal and may be insulated with additional material as well. The overall weight of fountain 10 is such that it is easily transportable.

Second container 36 has a hose attachment 50 located at the outer ridge 52 and a recessed handle 54 formed into its top.

Figure 4:
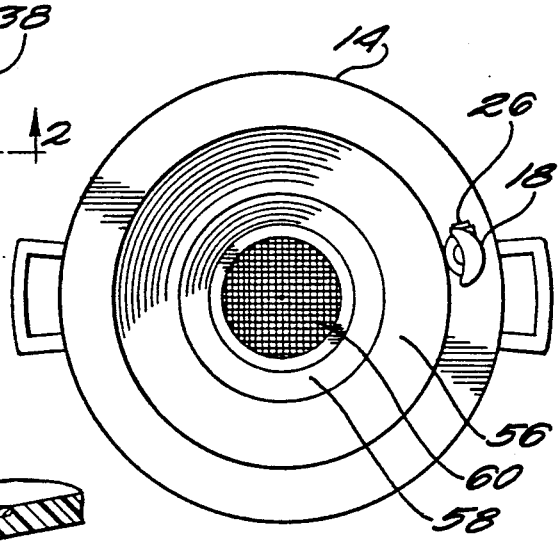
FIG. 4 is a top view of the present invention.

FIG. 4 illustrates lid 14 with spout 18. Spout has activating button 26 which, when depressed, releases the pressure on the liquid within first container 20 and causes liquid therein to come through spout 18 in an arc from which a child may drink. Liquid not consumed is caught in lid 14 and flows down the sloping sides 56 of lid 14 and into drain 30.

Figure 5:
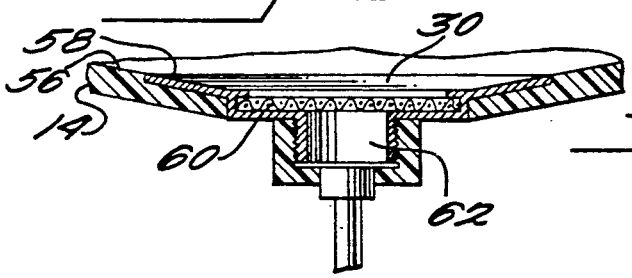
FIG. 5 is a detailed partial cross section of the drain portion of the lid of the present invention.

FIG. 5 illustrates drain 30 in detail. Recessed into sloping sides 56 of lid 14 is a lip 58 which holds a screen 60 in place over the drain opening 62. Screen 60 may be removed and cleaned or replaced periodically.

Because second container 36 is provided to collect the liquid not consumed, the liquid provided by fountain 10 may be other than water, for example, a sports beverage such as "GATORADE" or a flavored beverage such as "KOOL-AID." The excess will be collected in second container 36 rather than be discharged on the ground and disposed of properly. Shell 10 prevents easy access to first and second containers 20, 36 by children and simplifies transport of fountain 10.

While the invention has been described in terms of what is presently regarded as the preferred embodiment, it will be understood by those of ordinary skill in the art that various modifications and changes may be made which will nevertheless remain within the spirit and scope of the invention as defined by the claims which follow.

What is claimed is:

1. A fountain for presenting a liquid for drinking, said fountain comprising:

a shell housing;

a lid carried by said shell housing, said lid having a drain;

a spout carried by said lid, said spout positioned proximate said drain;

a first container for holding said liquid, said first container removably contained within said shell housing, said first container in fluid communication with said spout;

a second container for holding said liquid, said second container removably contained within said shell housing, said second container in fluid communication with said drain;

means for aligning said first and second containers in side-by-side relationship within said housing; and means for pressurizing said first container, said pressurizing means carried by said first container.

2. The fountain as recited in claim 1, wherein said aligning means further comprises first means formed in said first container for nesting said first container and second means formed in said second container for nesting said second container, said first means receiving said second means in nested, side-by-side relation.

3. The fountain as recited in claim 2, wherein said first nesting means is a slot formed in said first container, and wherein said second nesting means is a groove formed in said second container, said slot dimensioned to receive said groove.

4. The fountain as recited in claim 1, wherein said second container has means formed therein for lifting said second container from alignment with said first container.

5. The fountain as recited in claim 4, wherein said lifting means is a recess formed in said second container for receiving fingers so that said second container can be lifted.

6. The fountain as recited in claim 1, wherein said shell housing further comprises means for insulating said liquid in said first container.

7. The fountain as recited in claim 1, wherein said means for pressurizing said first container is a hand pump attached to said first container, said first container pressured by pumping said hand pump.

8. A fountain, comprising:

a shell housing;

a lid carried by said shell housing, said lid having a drain;

a spout carried by said lid, said spout positioned proximate said drain;

a first container for holding said liquid, said first container removably contained within said shell housing, said first container in fluid communication with said spout;

a second container for holding said liquid, said second container removably contained within said shell housing, said second container in fluid communication with said drain;

means for aligning said first and second containers in side-by-side relationship within said housing;

means for pressurizing said first container, said pressurizing means carried by said first container; and a drinkable liquid carried within said first container.

9. The fountain as recited in claim 8, wherein said aligning means further comprises first means formed in said first container for nesting said first container and second means formed in said second container for nesting said second container, said first means receiving said second means in nested, side-by-side relation.

10. The fountain as recited in claim 9, wherein said first nesting means is a slot formed in said first container, and wherein said second nesting means is a groove formed in said second container, said slot dimensioned to receive said groove.

11. The fountain as recited in claim 8, wherein said shell housing further comprises means for insulating said liquid in said first container.

* * * * *